US007712507B2

(12) United States Patent
Huang

(10) Patent No.: US 7,712,507 B2
(45) Date of Patent: May 11, 2010

(54) TAPE DISPENSER WITH CUTTER SHIELD

(76) Inventor: Harrison Huang, No. 23, Lin T'So Rd., Sheng Kang Hsian, Taichung Hsien (TW) 429

( * ) Notice: Subject to any disclaimer, the term of this patent is extended or adjusted under 35 U.S.C. 154(b) by 1028 days.

(21) Appl. No.: 11/435,856

(22) Filed: May 18, 2006

(65) Prior Publication Data

US 2007/0267455 A1 Nov. 22, 2007

(51) Int. Cl.
*B65H 35/07* (2006.01)

(52) U.S. Cl. ..... 156/527; 156/574; 156/577; 225/20

(58) Field of Classification Search ..... 156/523, 156/527, 574, 577, 579; 225/20
See application file for complete search history.

(56) References Cited

U.S. PATENT DOCUMENTS 5,928,466 A * 7/1999 Yu Chen ..... 156/527
6,296,033 B1 * 10/2001 Clements ..... 156/527
6,491,082 B1 * 12/2002 Fu ..... 156/527
6,789,594 B1 * 9/2004 Yu Chen ..... 156/523
6,799,623 B1 * 10/2004 Cheng ..... 156/527
7,017,639 B2 * 3/2006 McDonald ..... 156/527
2002/0195204 A1 * 12/2002 Huang ..... 156/577

* cited by examiner

*Primary Examiner*—Mark A Osele
(74) *Attorney, Agent, or Firm*—Bacon & Thoman, PLLC

(57) ABSTRACT

A tape dispenser includes a main member, on which a tape roll mount, a cutter and a movable shield are provided, wherein the shield is moved to cover or expose the cutter, and at least a flexible arm is projected from the shield directly. The flexible arm has a suspended end urging a bottom wall of the main member. The flexible arm is compressed when the shield is moved to expose the cutter, and the compressed flexible arm may return the shield to cover the cutter automatically.

6 Claims, 6 Drawing Sheets

TAPE DISPENSER WITH CUTTER SHIELD

BACKGROUND OF THE INVENTION

1. Field of the Invention

The present invention relates generally to a tape dispenser, and more particularly to a tape dispenser with cutter shield.

2. Description of the Related Art

Some conventional tape dispensers are provided with means to protect user from hurt by cutter. Typically, such means include a movable cutter or a movable shield. The movable cutter is received in the dispenser in a normal condition and moves out when user wants to cut the tape off only. The movable shield covers the cutter in a normal condition and moves off the cutter when user wants to cut the tape off.

Both of the movable cutter and movable shield are provided with a spring member to return the cutter or shield. The spring member usually is an independent element, which means it needs more steps to assemble the spring member on the tape dispenser.

SUMMARY OF THE INVENTION

The primary objective of the present invention is to provide a tape dispenser, which has a cutter shield with simple structure and beneficial to assembly.

According to the objective of the present invention, a tape dispenser includes a main member, on which a tape roll mount, a cutter and a movable shield are provided, wherein the shield is moved to cover or expose the cutter, and at least a flexible arm is projected from the shield directly. The flexible arm has a suspended end urging a bottom wall of the main member. The flexible arm is compressed when the shield is moved to expose the cutter, and the compressed flexible arm may return the shield to cover the cutter automatically.

DETAILED DESCRIPTION OF THE INVENTION

A tape dispenser of the preferred embodiment of the present invention includes a main member 10, a tape roll mount 20, a cutter 54 and a shield 56.

Figure 6:
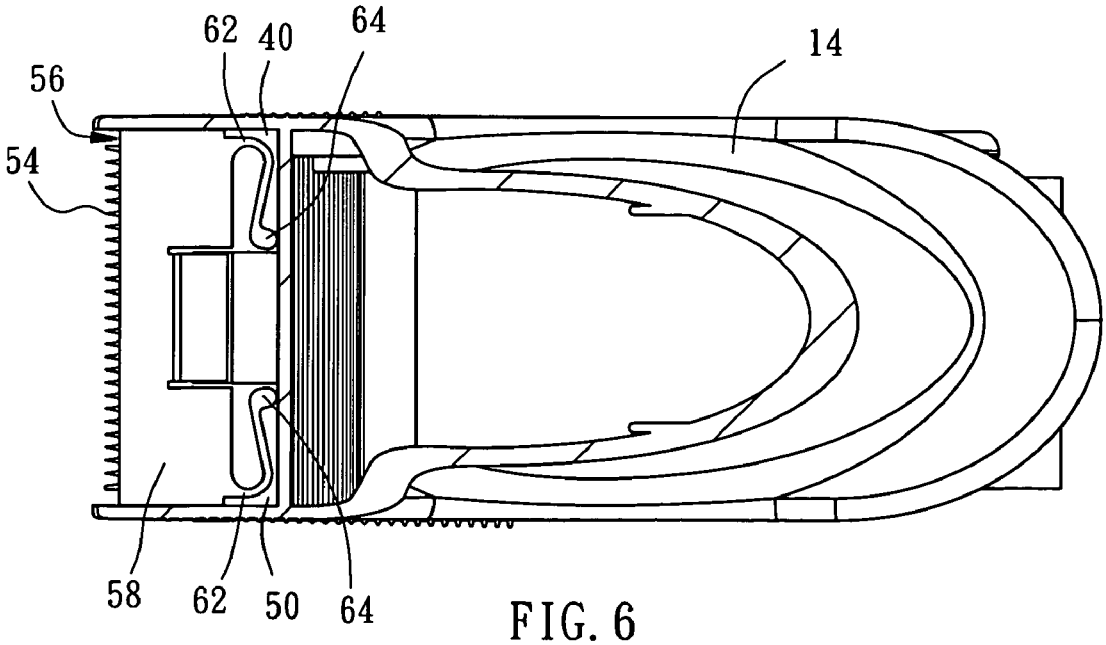
FIG. 6 and FIG. 8 are two sectional views of the preferred embodiment of the present invention, showing the shield exposing the cutter.
Figure 7:
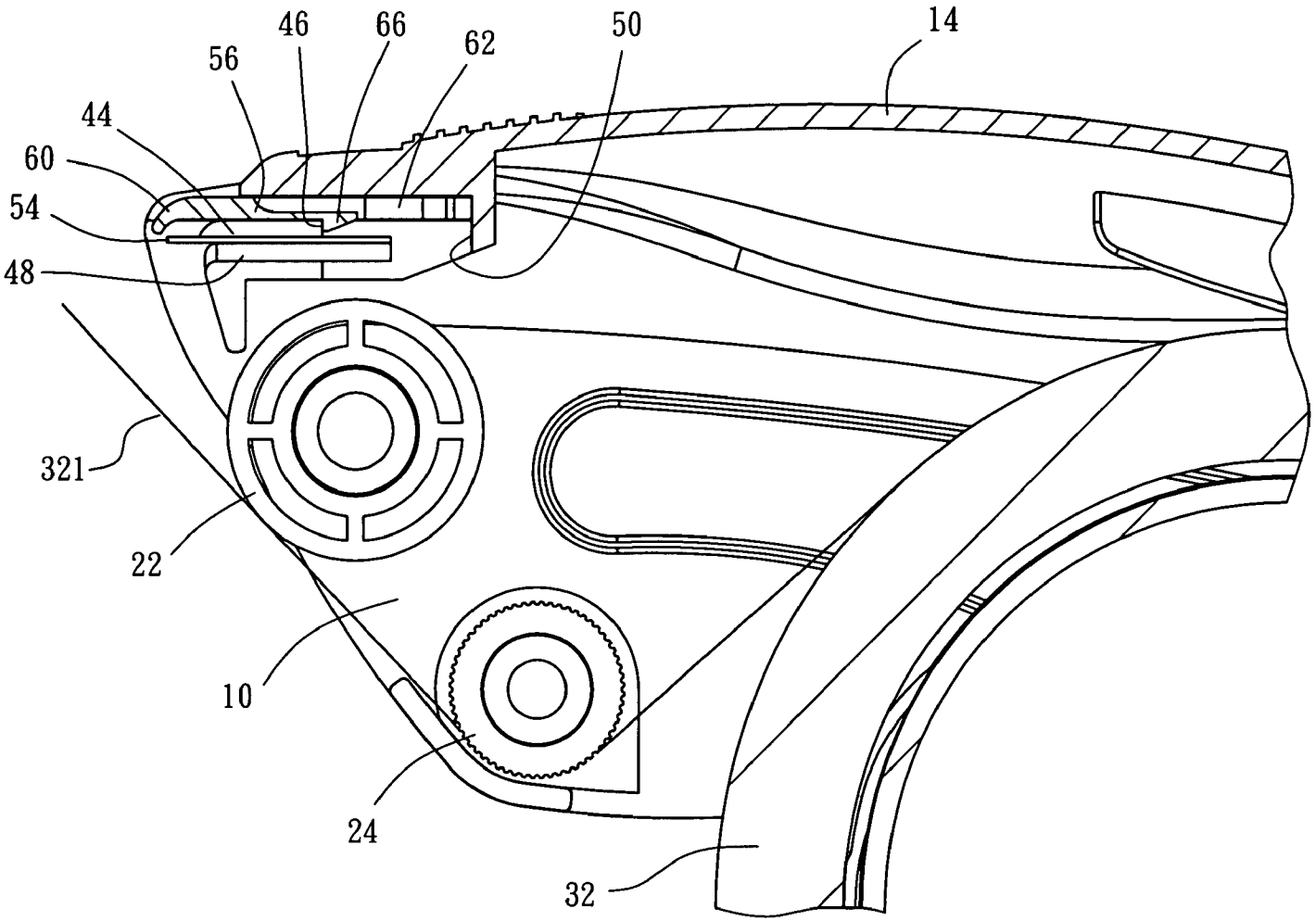

As shown in FIG. 1 to FIG. 4, the main member 10 includes a base plate 12 and a swing plate 14. The base plate 12 has a first post 16, a second post 18, and the tape roll mount 20 on an interior side thereof. A first roller 22 and a second roller 24 are fitted to the first post 16 and the second post 18 respectively. The first post 16 has a block 26 at a distal end thereof, and the base plate 12 also has a block 26 at an exterior side associated with the first post 16. A screw 28 is screwed into a distal end of the second post 18 to keep the second roller 24 on the second post 18. The tape roll mount 20 is a hollow column, on a circumference of which two suspended elastic plates 30 are provided. A tap roll 32 may be fitted to the tape roll mount 20 with the elastic plates 30 pressing it. The elastic plates 30 may prevent the tap roll 32 from turning reversely. The swing plate 14 mad a main plate 34 and two lateral plates 36 on opposite ends of the main plate 34. Each of the lateral plates 36 has a bore 38 to be fitted to the blocks 26 of the base plate 12, such that the swing plate 14 is connected to the base plate 12 and may be swung relative to the base plate 12. The main plate 34 has two slots 40, 42 at a front end thereof, and between the slots 40, 42 is a wall 44. The wall 44 has a stop portion 46 at a rear end thereof, as shown in FIG. 6 and FIG. 7. Two protrusions 48 are projected from a lower side of the lower slot 42, and the upper slot 40 has a bottom wall 50. The cutter 54 is fixed in the lower slot 42 and rested on the protrusions 48, and the shield 56 is received in the upper slot 40.

Figure 1:
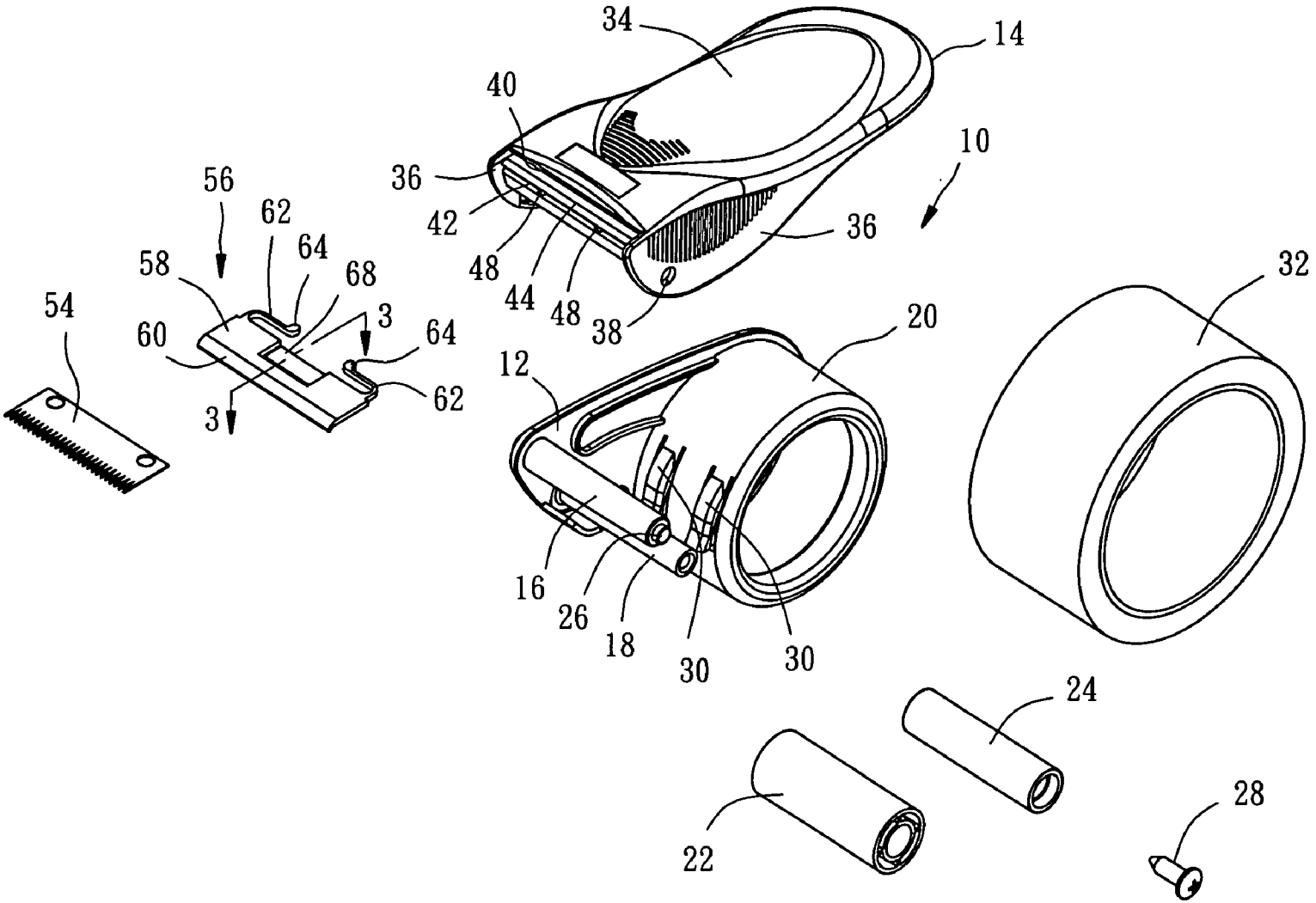
FIG. 1 is an exploded view of a preferred embodiment of the present invention.
Figure 2:
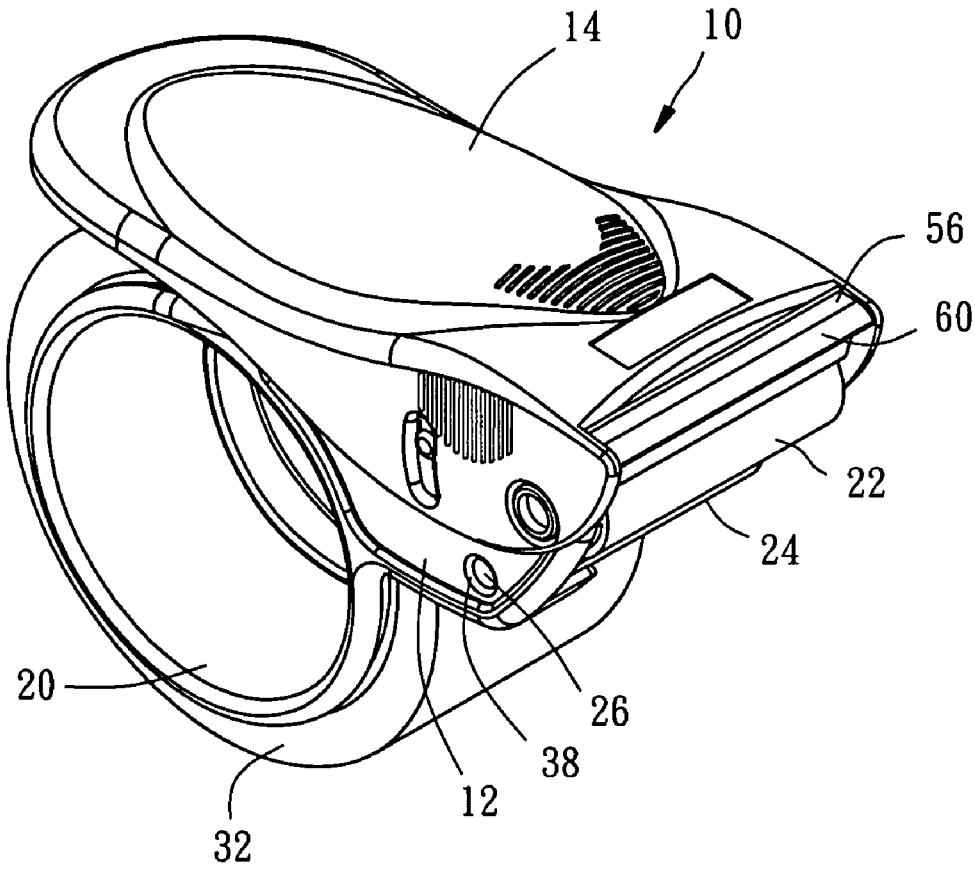
FIG. 2 is a perspective view of the preferred embodiment of the present invention.
Figure 3:
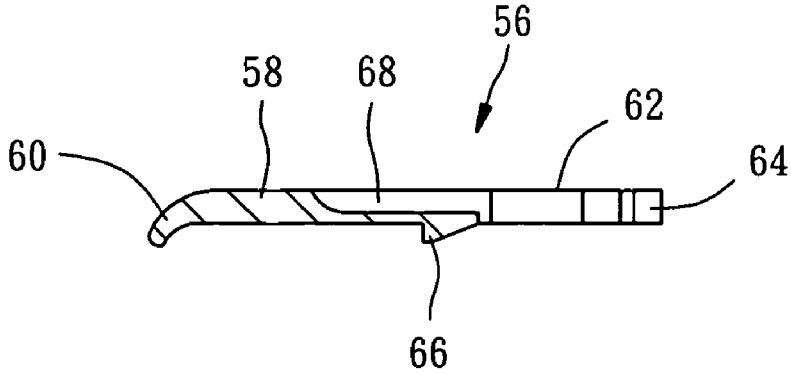
FIG. 3 is sectional view of the shield along 3-3 line of FIG. 2.
Figure 4:
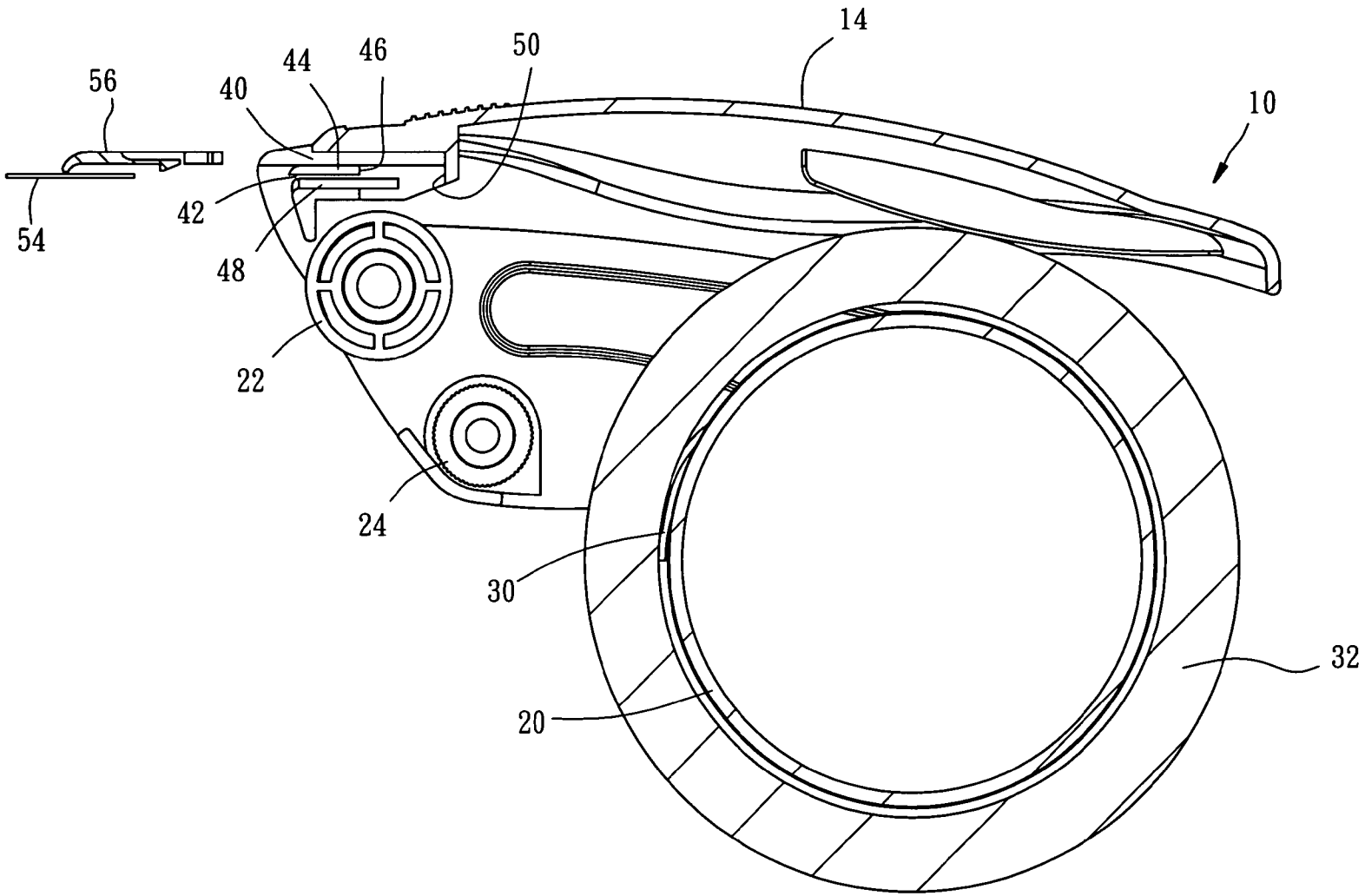
FIG. 4 is a sectional view of the preferred embodiment of the present invention.

The shield 56, as shown in FIG. 1 and FIG. 3, has a plate 58 with a curved portion 60 at a front end thereof and two flexible arms 62 at a rear end thereof. The curved portion 60 is bent toward the cutter 54, such that the shield 56 is closer to the cutter 54. The flexible arms 62 are projected from opposite sides of the rear end of the plate 58 and bent inwards, such that the flexible arms 62 have suspended distal ends. Each of the flexible arms 62 has a head 64 at the distal end. The plate 58 has a hook portion 66 at a bottom side adjacent to the rear end and an indentation at a top side above the hook portion 66. As a result, the plate 58 is thinner at a region of the hook portion 66 that makes the hook portion flexible. The shield 56 is inserted into the upper slot 40 of the main plate 56 with the hook portion 66 across the wall 44 and the heads 64 of the flexible arms 62 rested on the bottom wall 50. A distance between the bottom wall 50 and the stop portion 46 is slightly less than that between the heads 64 of the flexible arms 62 and the hook portion 66, such that the flexible arms 62 are slightly compressed with the heads 64 urging the bottom wall 50 and the hook portion 46 pressing the stop portion 46 in a normal condition that keeps the shield 56 tight in the slot 40.

Figure 5:
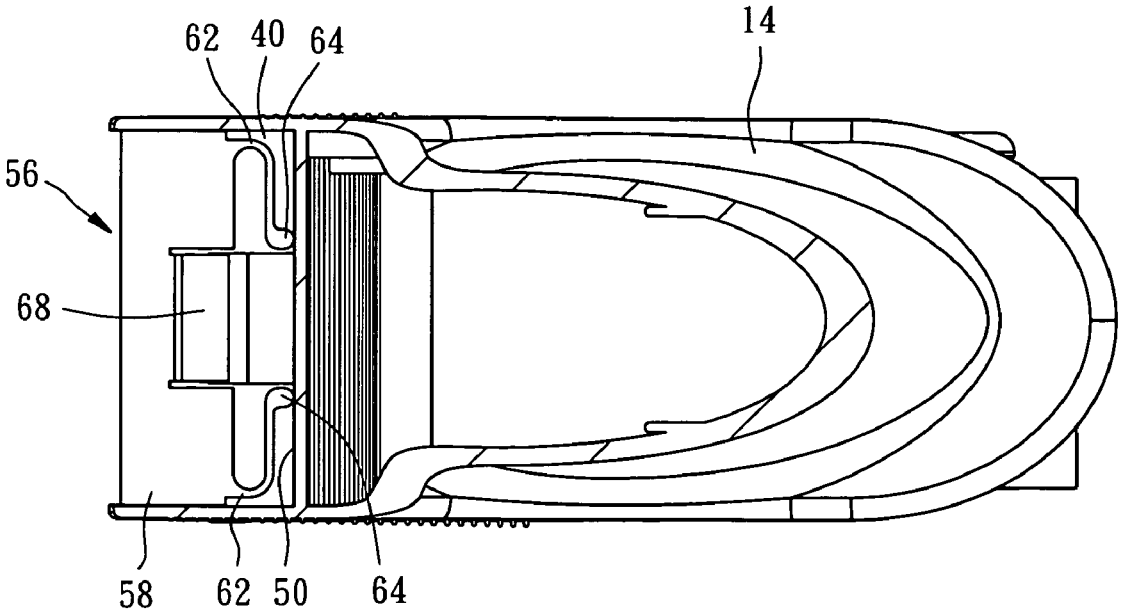
FIG. 5 and FIG. 7 are two sectional views of the preferred embodiment of the present invention, showing the shield covering the cutter.
Figure 8:
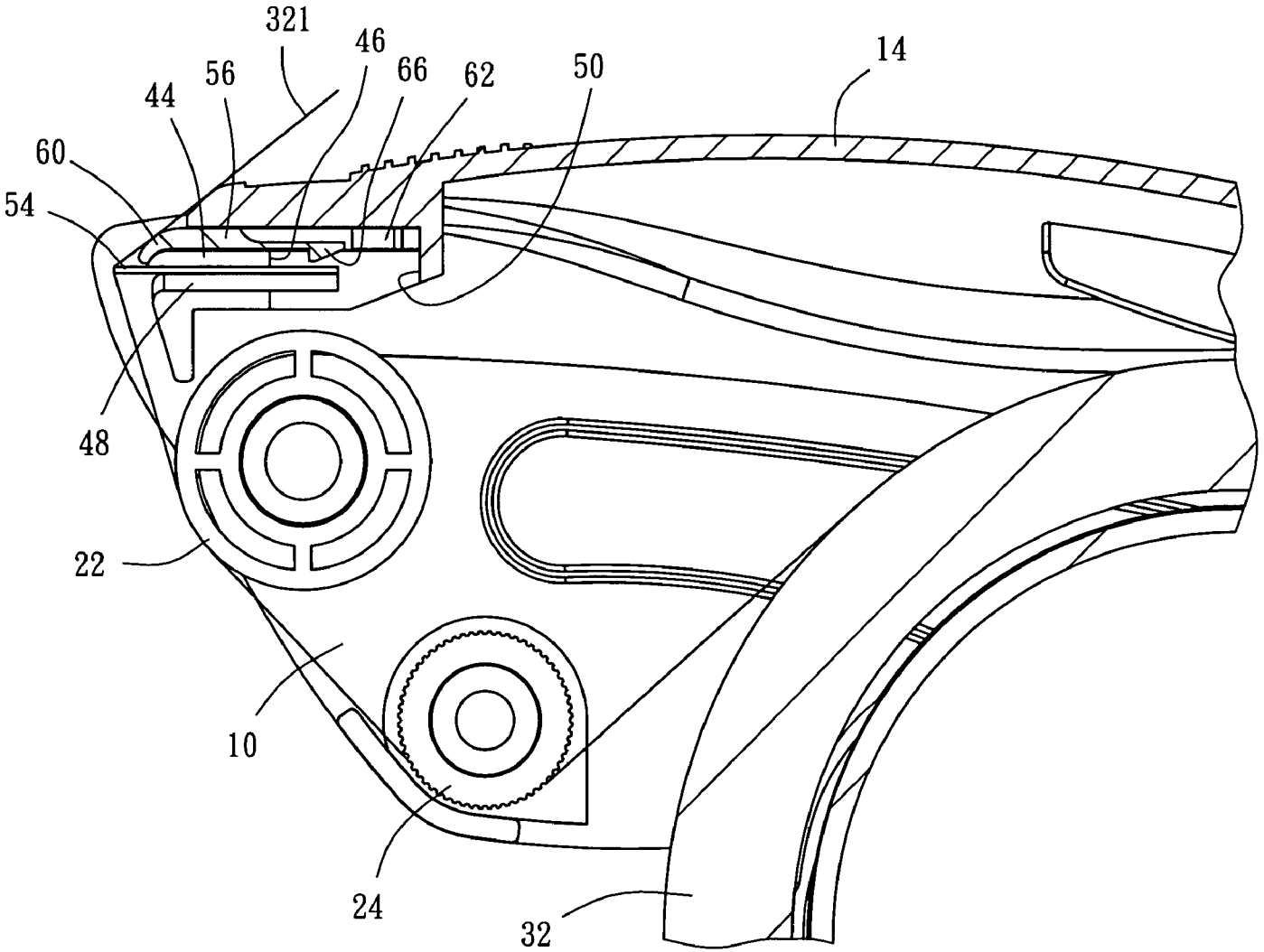

As shown in FIG. 5 and FIG. 7, in the normal condition, the shield 56 covers the cutter 54 to prevent the cutter 54 hurting user. When user wants to cut a tape 321 off, as shown in FIG. 6 and FIG. 8, user has to hold the tail of the tape 321 and draw it to the rear of the tape dispenser (referring to FIG. 8). At this moment, the tape 321 will press the shield 54 to move it into the slot 40, and that will expose the cutter 54, such that the tape 321 will press the exposed cutter 54 and is cut off. When the shield 54 is moved into the slot 40, the flexible arms 62 are compressed, and when the tape 321 is cut off, the flexible arms 62 will return the shield 54 until the hook portion 66 touches the stop portion 46 that the shield 54 covers the cutter 56 again.

It is noted that the shield of the present invention may be incorporated in any types of the tape dispensers. The description above is a few preferred embodiments of the present invention and the equivalence of the present invention is still in the scope of the claim of the present invention.

What is claimed is:

1. A tape dispenser, comprising a main member, on which a tape roil mount, a cutter and a movable shield are provided, wherein the shield is moved to cover or expose the cutter, and at least a flexible arm is projected from the shield directly and, has a suspended end urging a bottom wall of the main member, whereby the flexible arm is compressed when the shield is moved to expose the cutter, and the compressed flexible arm may return the shield to cover the cutter automatically, wherein the main member includes two slots, one of which receives the cutter therein, the other of which receives the shield therein, the shield has a hook portion to be engaged with a stop portion of the main member, and a distance between the bottom wall and the stop portion of the main member is slightly less than a distance between the suspended end of the flexible arm and the hook portion.

2. The tape dispenser as defined in claim 1, wherein the flexible arm has a head on a distal end thereof to touch the main member.

3. The tape dispenser as defined in claim 1, wherein the shield has a portion, on which the hook portion is provided, with a thickness thinner than the rest of the shield to provide the hook portion with flexibility.

4. The tape dispenser as defined in claim 1, wherein the main member has protrusions in the slot to rest the cutter thereon.

5. The tape dispenser as defined in claim 1, wherein the shield has a curved portion at a front end thereof, which is bent proximal to the cutter.

6. A tape dispenser, comprising a main member, on which a tape roll mount, a cutter and a movable shield are provided, wherein the shield is moved to cover or expose the cutter, and at least a flexible arm is projected from the shield directly and has a suspended end urging a bottom wall of the main member, whereby the flexible arm is compressed when the shield is moved to expose the cutter, and the compressed flexible arm may return the shield to cover the cutter automatically, wherein the main member includes two slots, one of which receives the cutter therein, the other of which receives the shield therein, the shield has a hook portion to be engaged with a stop portion of the main member.

* * * * *